US009037058B2

(12) United States Patent
Iwata

(10) Patent No.: US 9,037,058 B2
(45) Date of Patent: May 19, 2015

(54) FIXING DEVICE INCLUDING NIP MEMBER, BACKUP MEMBER AND BIASING MEMBER FOR PRESSING NIP MEMBER TOWARD BACKUP MEMBER

(75) Inventor: Naoyuki Iwata, Kakamigahara (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 152 days.

(21) Appl. No.: 13/429,597

(22) Filed: Mar. 26, 2012

(65) Prior Publication Data

US 2013/0084111 A1 Apr. 4, 2013

(30) Foreign Application Priority Data

Sep. 29, 2011 (JP) ..... 2011-214270

(51) Int. Cl.
*G03G 15/20* (2006.01)

(52) U.S. Cl.
CPC .... *G03G 15/2053* (2013.01); *G03G 2215/2035* (2013.01)

(58) Field of Classification Search
USPC ..... 399/329
See application file for complete search history.

(56) References Cited

U.S. PATENT DOCUMENTS

| | | | | |
|---|---|---|---|---|
| 5,267,005 | A | 11/1993 | Yamamoto et al. | |
| 7,167,670 | B2 * | 1/2007 | Obata et al. | 399/329 |
| 7,177,579 | B2 * | 2/2007 | Uchida et al. | 399/328 |
| 7,627,278 | B2 * | 12/2009 | Nakagawa et al. | 399/329 |
| 7,953,361 | B2 * | 5/2011 | Obata et al. | 399/329 |
| 8,160,485 | B2 * | 4/2012 | Hayase | 399/329 |
| 2009/0052925 | A1 * | 2/2009 | Fujimoto | 399/67 |
| 2009/0175645 | A1 * | 7/2009 | Seol et al. | 399/69 |
| 2011/0150544 | A1 * | 6/2011 | Ishida et al. | 399/328 |
| 2011/0164905 | A1 * | 7/2011 | Kondo et al. | 399/328 |
| 2011/0170920 | A1 | 7/2011 | Fujiwara et al. | |
| 2013/0330111 | A1 * | 12/2013 | Tokuda | 399/329 |
| 2014/0016972 | A1 * | 1/2014 | Seshita et al. | 399/329 |
| 2014/0294462 | A1 * | 10/2014 | Murodate et al. | 399/329 |
| 2014/0294463 | A1 * | 10/2014 | Iwata et al. | 399/329 |
| 2014/0294464 | A1 * | 10/2014 | Maruyama et al. | 399/329 |
| 2014/0294465 | A1 * | 10/2014 | Hazeyama et al. | 399/329 |

FOREIGN PATENT DOCUMENTS

| | | |
|---|---|---|
| JP | 04-242774 | 8/1992 |
| JP | 08-006409 | 1/1996 |
| JP | 2009-151227 | 7/2009 |
| JP | 2011-137933 | 7/2011 |

* cited by examiner

*Primary Examiner* — David Gray
*Assistant Examiner* — Geoffrey Evans
(74) *Attorney, Agent, or Firm* — Banner & Witcoff, Ltd.

(57) ABSTRACT

There is provided a fixing device configured to thermally fix a developer image onto a sheet, the fixing device including: a flexible tubular member; a nip member; a backup member; a first member: a second member: a biasing member; and a transmission member. The biasing member presses the nip member toward the backup member side through the first member and the second member by biasing both end portions of the first member in a width direction of the sheet toward the backup member. The transmission member is provided between the first member and the second member. The transmission member transmits a biasing force, which is applied from the biasing member to the first member, to a center portion of the second member in the width direction of the sheet.

11 Claims, 9 Drawing Sheets

FIXING DEVICE INCLUDING NIP MEMBER, BACKUP MEMBER AND BIASING MEMBER FOR PRESSING NIP MEMBER TOWARD BACKUP MEMBER

CROSS-REFERENCE TO RELATED APPLICATIONS

This application claims priority from Japanese Patent Application No. 2011-214270 filed on Sep. 29, 2011, the entire contents of which are incorporated herein by reference.

TECHNICAL FIELD

Aspects of the present invention relate to a fixing device for thermally fixing a developer image onto a sheet.

BACKGROUND

In related art, a fixing device having a flexible tubular member, a nip member arranged inside the tubular member, a pressure roller forming a nip portion by sandwiching the tubular member between the nip member and the pressure roller, and a rigid stay supporting the nip member from the opposite side of the pressure roller is known (see JP 2011-137933). According to this technique, both end portions of the stay (both end portions in an axis direction of the tubular member) are biased toward the pressure roller by a biasing member, and thus the nip member is in pressure contact with the pressure roller via the tubular member.

SUMMARY

However, according to the technique in the related art, since the both end portions of the stay are biased by the biasing member, points which are a little more inside than bias force acting points may become support points and a center portion of the stay may be distorted and spaced apart from the pressure roller. On the other hand, since the pressure roller receives a reaction force from a housing that supports both ends of the pressure roller, points which are a little more inside than reaction force acting points (both ends of the pressure roller) may become support points and a center portion of the pressure roller may be distorted and spaced apart from the stay.

If the respective center portions are distorted, the width of the nip portion becomes small at the center thereof, and becomes large at both end portions thereof. Accordingly, a sheet that passes through the nip portion may not be conveyed successfully, or fixing quality may deteriorate.

Accordingly, the present invention has been made in view of the above-described situations, and the subject to be solved by the invention is to provide a fixing device which can make the nip width substantially uniform.

According to an aspect of the invention, there is provided a fixing device configured to thermally fix a developer image onto a sheet, the fixing device including: a flexible tubular member; a nip member; a backup member; a first member: a second member: a biasing member; and a transmission member. The nip member is arranged inside the tubular member. The backup member configures a nip portion by sandwiching the tubular member between the nip member and the backup member. The first member is arranged inside the tubular member and is arranged on one side of the nip member, which is opposite to another side of the nip member at which the backup member is arranged. The second member is arranged between the first member and the nip member. The biasing member presses the nip member toward the backup member side through the first member and the second member by biasing both end portions of the first member in a width direction of the sheet toward the backup member. The transmission member is provided between the first member and the second member. The transmission member transmits a biasing force, which is applied from the biasing member to the first member, to a center portion of the second member in the width direction of the sheet.

Accordingly, the second member and the nip member can be distorted in the same direction as the direction in which the backup member is distorted, and thus the width of the nip portion can be substantially uniform.

DETAILED DESCRIPTION

Hereinafter, exemplary embodiments of the present invention will be described in detail with reference to the drawings. In the following description, the schematic configuration of a laser printer 1 (image forming apparatus) having a fixing device according to an exemplary embodiment of the present invention will be first described, and then the detailed configuration of the fixing device 100 will be described.

<Schematic Configuration of A Laser Printer>

Figure 1:
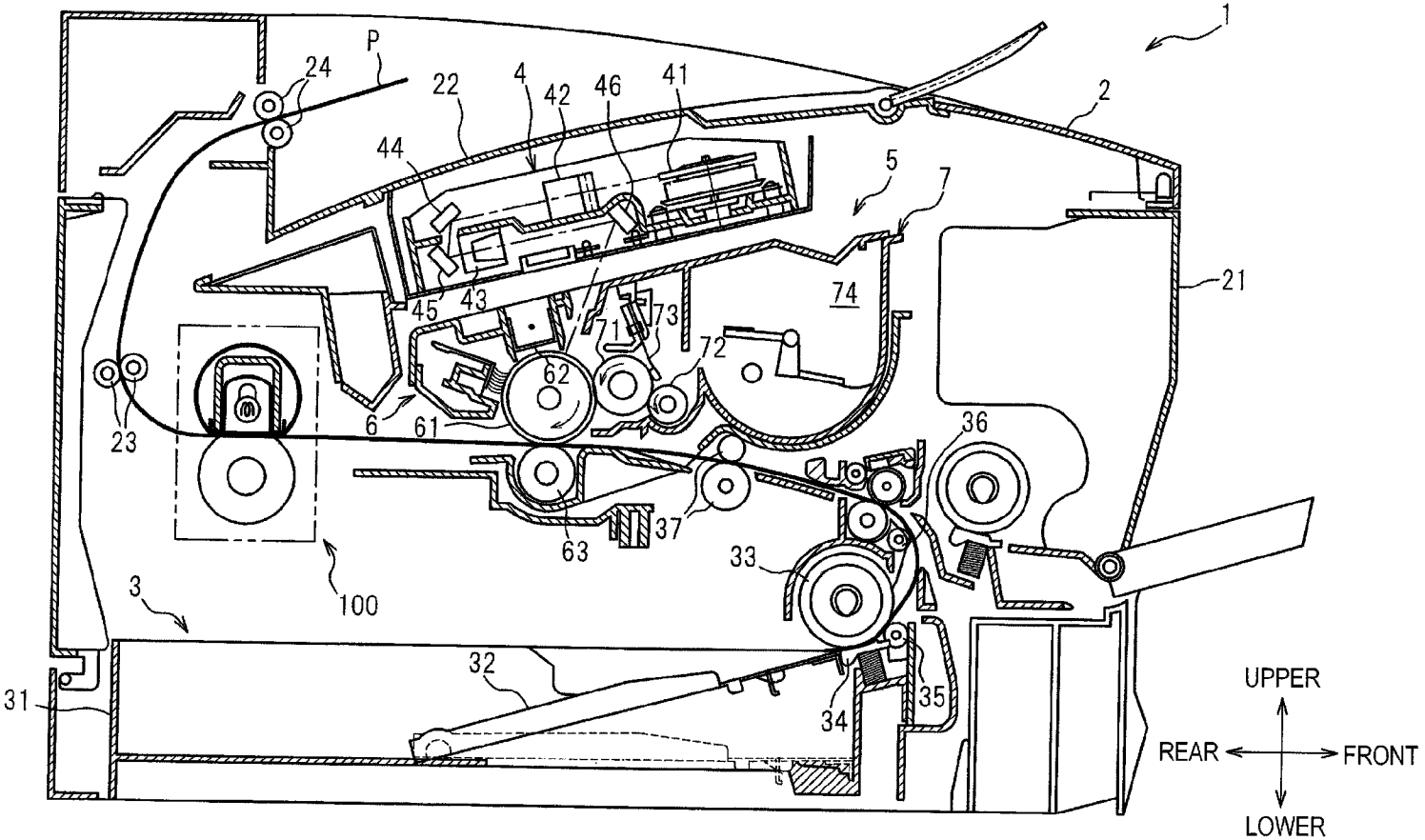
FIG. 1 is a view illustrating a schematic configuration of a laser printer having a fixing device according to an exemplary embodiment of the present invention.

As illustrated in FIG. 1, a laser printer 1 mainly includes a sheet feeding portion 3 supplying a sheet P as an example of a sheet, an exposure device 4, a process cartridge 5 transferring a toner image (developer image) onto the sheet P, and a fixing device 100 thermally fixing the toner image onto the sheet P, which are provided inside a body casing 2.

In the following description, direction will be described as direction based on a user who uses a laser printer. That is, a right side of FIG. 1 is called "front", a left side of FIG. 1 is called "rear", a front side of FIG. 1 is called "left", and a rear side of FIG. 1 is called "right". Further, upper and lower directions in FIG. 1 are called "upper and lower".

The sheet feeding portion 3 is installed on a lower portion in the body casing 2, and mainly includes a sheet feeding tray 31 accommodating sheets P, a sheet pressing plate 32 lifting up the front side of the sheet P, a sheet feeding roller 33, a sheet feeding pad 34, paper dust removing rollers 35 and 36, and a registration roller 37. The sheet P in the sheet feeding tray 31 is conveyed toward the sheet feeding roller 33 through the sheet pressing plate 32, is separated one by one by the sheet feeding pad 34, and is conveyed toward the process cartridge 5 after passing through the paper dust removing rollers 35 and 36 and the registration roller 37.

The exposure device 4 is arranged at an upper portion in the body casing 2, and mainly includes a rotary polygon mirror 41, lenses 42 and 43, and reflecting mirrors 44, 45, and 46. In the exposure device 4, laser light (see dashed line) based on image data that is emitted from a laser emission portion is reflected by or passes through the polygon mirror 41, the lens 42, the reflecting mirrors 44 and 45, the lens 43, and the reflecting mirror 46 in order, and is scanned at high speed on the surface of a photosensitive drum 61.

The process cartridge 5 is arranged lower to the exposure device 4 and is configured to be detachably mounted on the body casing 2 through an opening created by opening a front cover 21 provided to the body casing 2. The process cartridge 5 includes a drum unit 6 and a developing unit 7.

The drum unit 6 mainly includes the photosensitive drum 61, a charging unit 62, and a transfer roller 63. Further, the developing unit 7 is configured to be detachably mounted to the drum unit 6, and mainly includes a developing roller 71, a supply roller 72, a layer thickness regulating blade 73 and a toner accommodation portion 74 that accommodates toner.

In the process cartridge 5, the surface of the photosensitive drum 61 is uniformly charged by the charging unit 62, and is then exposed through high-speed scanning of laser light from the exposure device 4, so that an electrostatic latent image based on the image data is formed on the photosensitive drum 61. Further, the toner in the toner accommodation portion 74 is supplied to the developing roller 71 through the supply roller 72, and enters between the developing roller 71 and the layer thickness regulating blade 73 to be carried on the developing roller 71 as a thin layer with a constant thickness.

The toner carried on the developing roller 71 is supplied from the developing roller 71 to the electrostatic latent image that is formed on the photosensitive drum 61. Accordingly, the electrostatic latent image becomes a visible image, and a toner image is formed on the photosensitive drum 61. Thereafter, the toner image on the photosensitive drum 61 is transferred onto the sheet P through conveyance of the sheet P between the photosensitive drum 61 and the transfer roller 63.

The fixing device 100 is provided to the rear side of the process cartridge 5. The toner image transferred onto the sheet P passes through the fixing device 100 to be thermally fixed onto the sheet P. The sheet P on which the toner image is thermally fixed is discharged into a sheet output tray 22 by conveyance rollers 23 and 24.

<Detailed Configuration of A Fixing Device>

Figure 2:
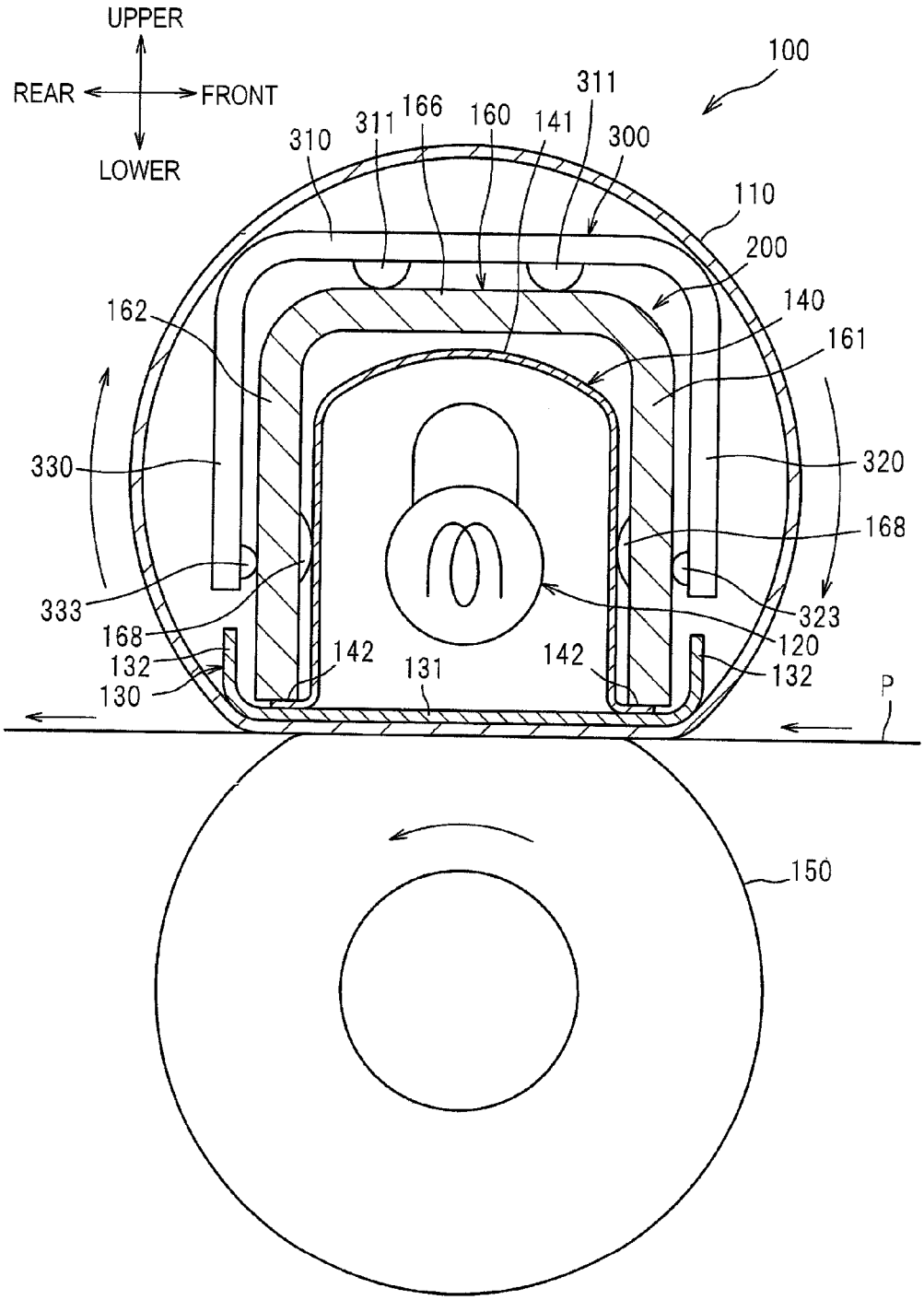
FIG. 2 is a view illustrating a schematic configuration of a fixing device according to an exemplary embodiment of the present invention.

As illustrated in FIG. 2, the fixing device 100 mainly includes a fixing belt 110 as an example of the tubular member, a heating unit 220, a pressure roller 150 as an example of the backup member, a guide member 170 (see FIG. 5), and a cover member 300 as an example of the first member.

The fixing belt 110 is an endless (cylindrical) film having heat resistance and flexibility, and the rotation of both end portions thereof is guided by the guide member 170 (see FIG. 5).

The heating unit 200 is arranged inside the fixing belt 110, and mainly includes a halogen lamp 120, a nip plate 130 as an example of the nip member, a reflecting plate 140, and a stay 160 as an example of the second member.

The halogen lamp 120 is a known heater that heats the toner on the sheet P by heating the nip plate 130 and the fixing belt 110, and is arranged with a predetermined space from inner surfaces of the fixing belt 110 and the nip plate 130 inside the fixing belt 110.

The nip plate 130 is a plate-shaped member that is exposed to radiant heat from the halogen lamp 120, and is arranged to be in slide contact with the inner surface of the cylindrical fixing belt 110. Further, the nip plate 130 transmits the radiant heat from the halogen lamp 120 to the toner on the sheet P through the fixing belt 110.

The nip plate 130 is formed by bending, for example, an aluminum plate or the like, which has higher thermal conductivity than the steel stay 160 to be described later, in a substantially U-shape in a cross-sectional view. More particularly, the nip plate 130, in a cross-sectional view, includes a base portion 131 extending along the front-rear direction (the conveying direction of the sheet P) and a bent portion 132 that is bent upwardly.

On the other hand, the inner surface (upper surface) of the base portion 131 may be painted black or may be provided with a heat absorbing member. According to this, the radiant heat from the halogen lamp 120 can be efficiently absorbed.

Figure 3:
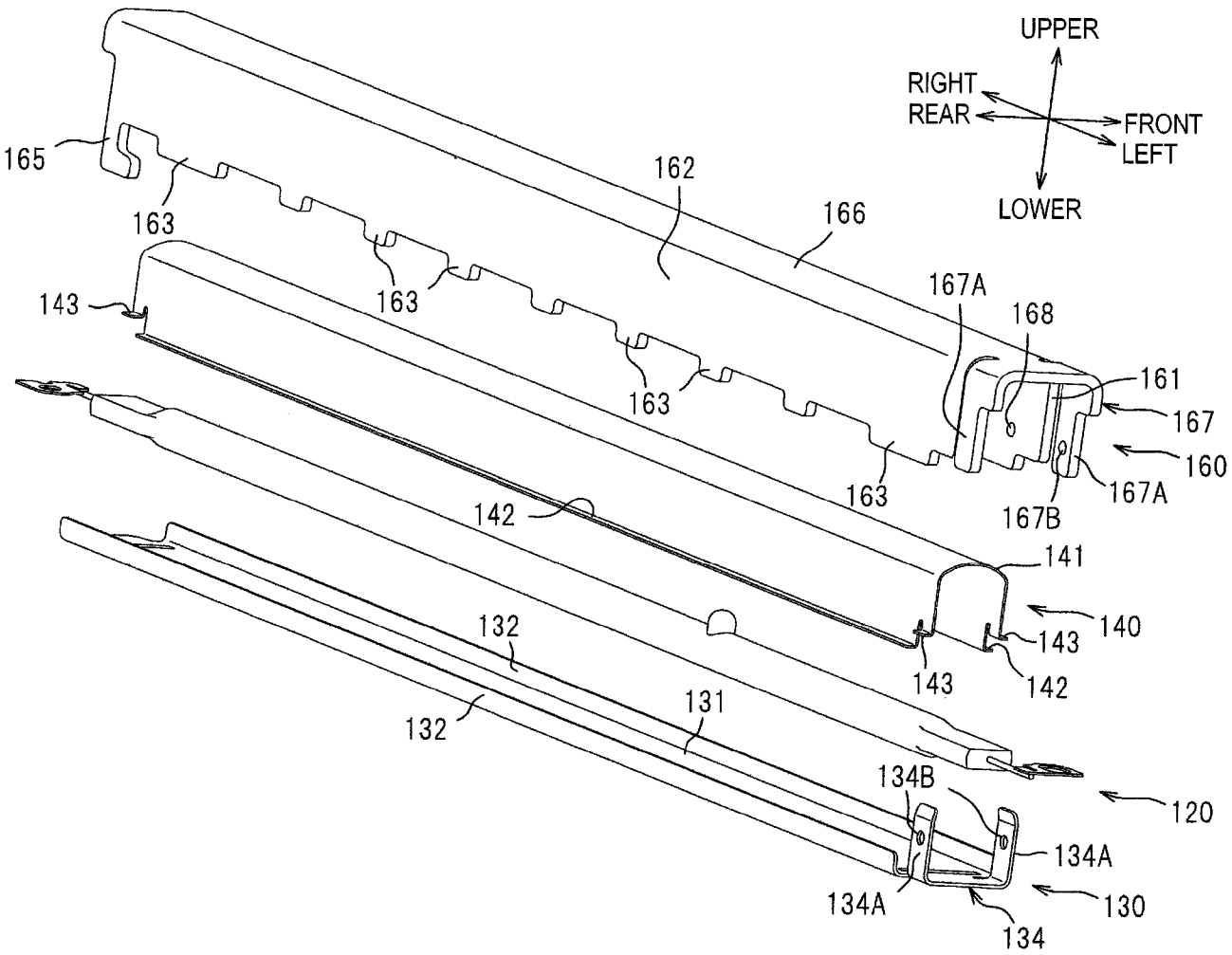
FIG. 3 is an exploded perspective view illustrating a heating unit in a disassembled state.

As illustrated in FIG. 3, on the left end portion of the base portion 131 of the nip plate 130, a U-shaped engagement portion 134 is formed as seen from the side surface that is opened upwardly. On a pair of side wall portions 134A of the engagement portion 134 which are upwardly bent, engagement holes 134B are provided.

As illustrated in FIG. 2, the reflecting plate 140 is a member that reflects the radiant heat from the halogen lamp 120 (radiant heat radiated mainly in the front-rear direction or in the upper direction) toward the nip plate 130, and is arranged at a predetermined interval from the halogen lamp 120 so as to surround the halogen lamp 120 at the inside of the fixing belt 110.

By gathering the radiant heat from the halogen lamp 120 onto the nip plate 130 through the reflecting plate 140, the radiant heat from the halogen lamp 120 can be efficiently used, and thus, the nip plate 130 and the fixing belt 110 can be quickly heated.

The reflecting plate 140 is formed by making, for example, an aluminum plate or the like, which has large infrared and far infrared reflectivity, be curved in substantially U-shape in a cross-sectional view. More specifically, the reflecting plate 140 mainly includes a reflecting portion 141 having a curved shape (substantially U-shape in a cross-sectional view), and a flange portion 142 extending along the outside in the front-rear direction from the both end portions of the reflecting portion 141. In order to heighten the heat reflectivity, the reflecting plate 140 may be formed using a mirror-finished aluminum plate or the like.

As illustrated in FIG. 3, at both end portions in the left-right direction (the width direction of the sheet P) of the reflecting plate 140, four flange type engagement portions 143 are formed in total (only three are illustrated). The engagement unit 143 is positioned upper to the flange portion 142 and is arranged to sandwich a plurality of contact portions 163 of the stay 160 to be described later in the left-right direction when the nip plate 130, the reflecting plate 140, and the stay 160 are assembled. Accordingly, it is possible to suppress the misalignment of the reflecting plate 140 against the stay 160 in the left-right direction.

As illustrated in FIG. 2, the pressure roller 150 is an elastically deformable member, and is arranged below the nip plate 130. Further, the pressure roller 150 in an elastically deformed state forms the nip portion between the fixing belt 110 and the pressure roller 150 by sandwiching the fixing belt 110 between the nip plate 130 and the pressure roller 150.

The pressure roller 150 is configured to be rotary driven by a driving force that is transmitted from a motor (not illustrated) installed inside the body casing 2, and rotates the fixing belt 110 by the frictional force between the fixing belt 110 (or sheet P).

The sheet P on which the toner image has been transferred is conveyed between the pressure roller 150 and the heated fixing belt 110 and thus the toner image is thermally fixed onto the sheet P.

The stay 160 is arranged between the cover member 300 and the nip plate 130, and ensures the rigidity of the nip plate 130 by supporting the both end portions of the nip plate 130 (base portion 131) in the front-rear direction through the flange portion 142 of the reflecting plate 140. The stay 160 has a shape (U-shape that is opened to the nip plate 130) according to an outer surface shape of the reflecting plate 140 (reflecting portion 141), and is arranged to cover the reflecting plate 140. The stay 160 is formed through bending, for example, a steel plate or the like, which has a relatively high rigidity, in a substantially U-shape in a cross-sectional view.

At lower ends of a front side wall 161 and a rear side wall 162 as an example of a pair of second walls opposing the conveying direction of the sheet P in the stay 160, as illustrated in FIG. 3, a plurality of contact portions 163, which are formed in a substantially comb shape, are provided.

Further, on the right end portions of the front side wall 161 and the rear side wall 162 of the stay 160, substantially L-shaped engagement portions 165 are provided to extend downward and to further extend toward the left direction. Accordingly, the right end portions of the nip plate 130 are supported by the respective engagement portions 165.

Further, at left ends of the stay 160, a substantially U-shaped holding portion 167, which opens downward in a side view, is provided. On inner surfaces of side wall portions 167A of the holding portion 167, engagement bosses 167B (only one of them is illustrated) that project toward the inside are provided. Further, by the respective engagement bosses 167B engaging with respective engagement holes 134B of the nip plate 130, an engagement portion 134 of the left end portion of the nip plate 130 is supported by the holding portion 167.

As illustrated in FIGS. 2 and 3, on both end portions in the left-right direction of the inner surfaces of the front side wall 161 and the rear side wall 162 of the stay 160, four contact bosses 168 that project toward the inside are provided in total. The contact bosses 168 contact with the reflecting plate 140 (reflecting portion 141) in the front-rear direction. Accordingly, the reflecting plate 140 is supported by the stay 160.

Figure 4:
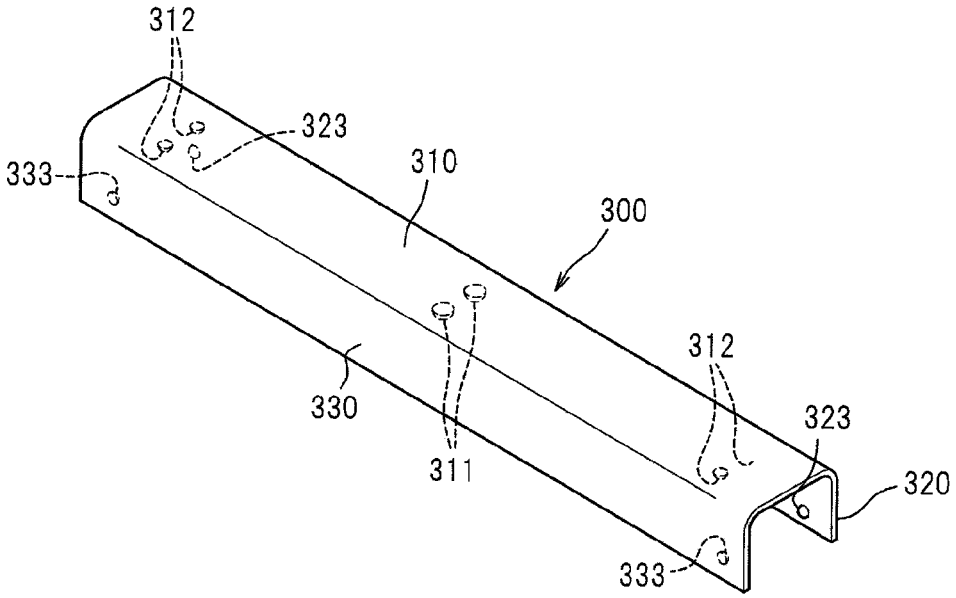
FIG. 4 is a perspective view illustrating a cover member.
Figure 5A:
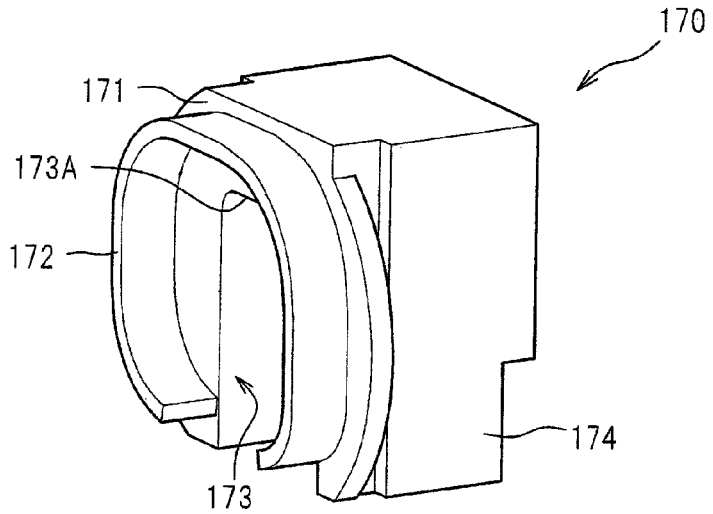
FIG. 5A is a perspective view of a guide member as seen from an upper side.

Further, the stay 160 that supports the nip plate 130 and the reflecting plate 140 is held by a cover member 300 illustrated in FIG. 4, and the cover member 300 is fixed to the guide member 170 illustrated in FIG. 5A. The details of the cover member 300 will be described later.

Further, the above-described halogen lamp 120 is also fixed to the guide member 170. That is, the guide member 170 integrally supports the nip plate 130, the reflecting plate 140, the stay 160, the cover member 300, and the halogen lamp 120.

The guide member 170 is formed of an insulating material such as resin or the like, and is arranged to both end sides of the fixing belt 110 to mainly regulate the position of the cross section of the fixing belt 110. Specifically, the guide member 170 includes a regulation surface 171 regulating the movement of the fixing belt 110 in the left-right direction, a suppression portion 172 suppressing the deformation of the fixing belt 110 inwardly in the radial direction, and a supporting concave portion 173 supporting the both end portions of the cover member 300.

The suppression portion 172 is a rib that projects from the regulation surface 171 inwardly in the left-right direction, and is formed in a C-shape that makes the opening face the bottom. Further, the suppression portion 172 enters into the fixing belt 110 to suppress the deformation of the fixing belt inwardly in the radial direction. Further, the opening that faces the bottom forms a relief portion for inserting the cover member 300 into the supporting concave portion 173.

Figure 5B:
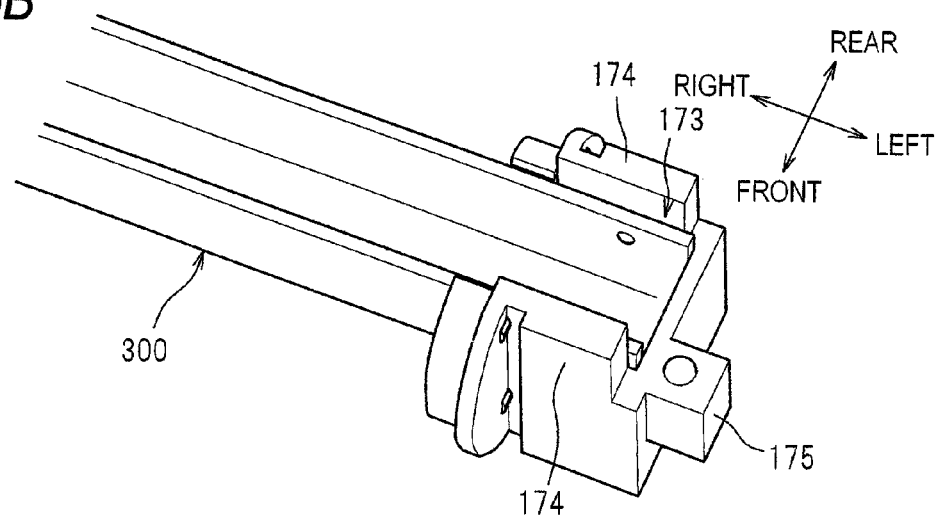
FIG. 5B is a perspective view of a guide member assembled with a stay as seen from a lower side.
Figure 5C:
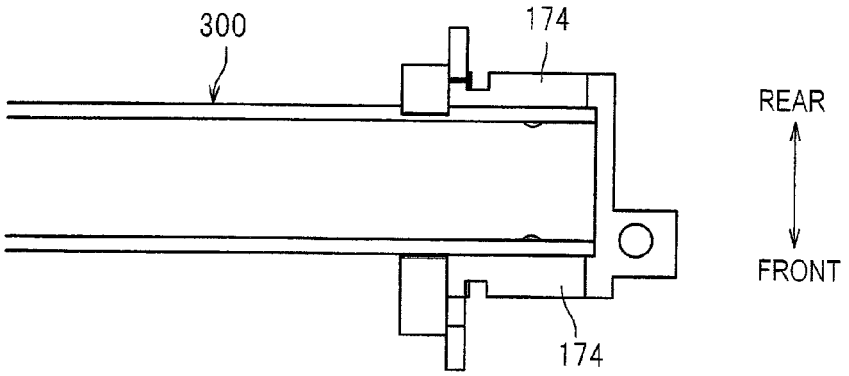
FIG. 5C is a bottom view of a guide member assembled with a stay.

The supporting concave portion 173 is a groove that is opened downward and inwardly in the left-right direction, and as illustrated in FIGS. 5B and 5C, supports the cover member 300 to sandwich the cover member 300 by means of a pair of side walls 174, which face each other in the front-rear direction, of walls that form the supporting concave portion 173. As described above, by supporting the cover member 300 by the guide member 170, the nip plate 130, the reflecting plate 140 and the stay 160 are integrally supported by the guide member 170 through the cover member 300.

Figure 6:
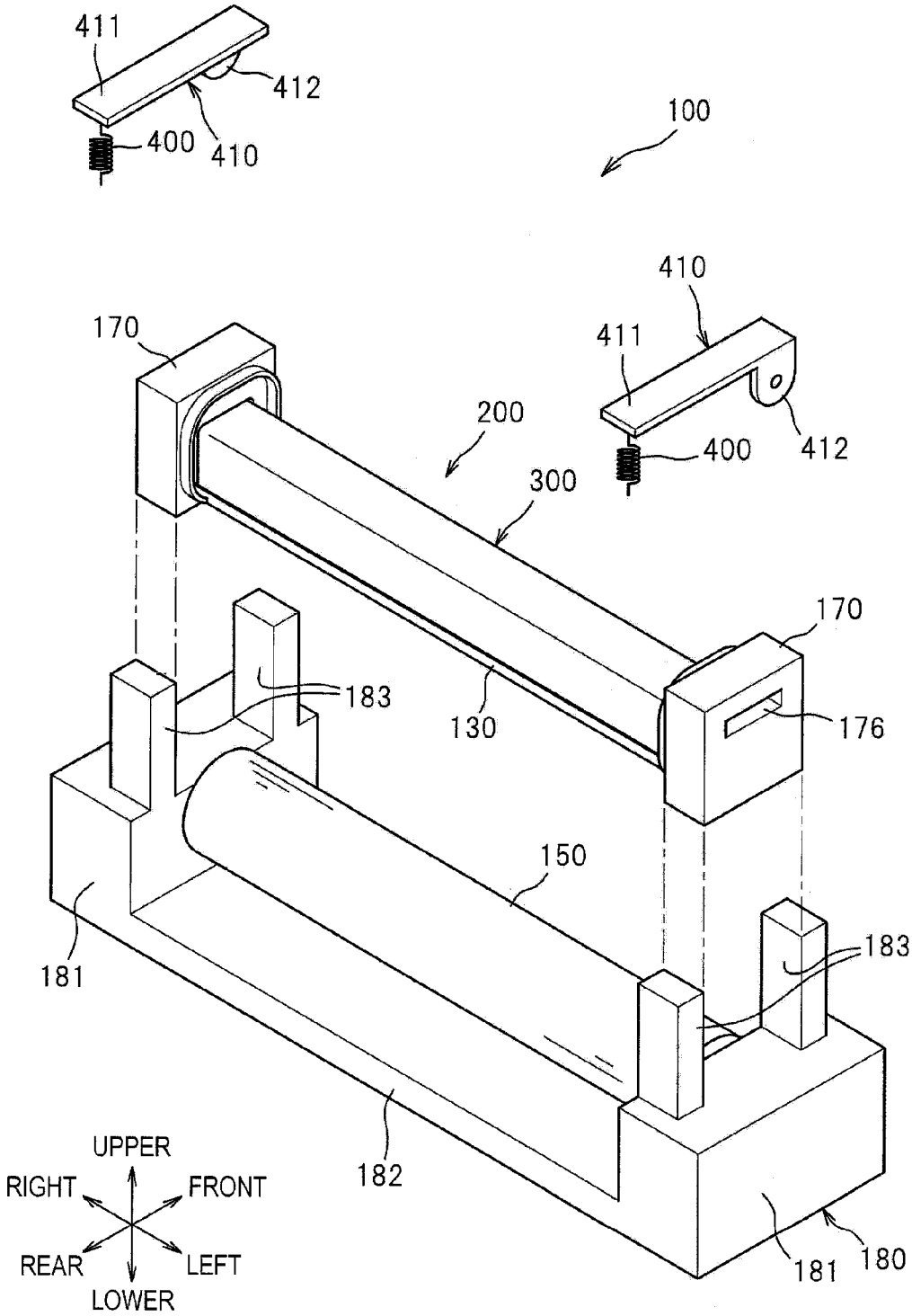
FIG. 6 is an exploded perspective view illustrating a fixing device in a simplified and disassembled manner.

Further, on the outer side in the left-right direction of the guide member 170, a fixture portion 175 for fixing the halogen lamp 120 is formed to project outwardly in the left-right direction. A terminal of the halogen lamp 120 fixed to the fixture portion 175 is electrically connected to power supply (not illustrated) of the body casing 2 of the laser printer 1 through a flexible wire. As illustrated in FIG. 6, the guide member 170 as configured above is movably supported upwardly and downwardly by the housing 180 while supporting the cover member 300 and the nip plate 130.

The housing 180 includes a pair of left and right side walls 181 and a lower side wall 182 connecting lower portions of the side walls 181. On the respective side walls 181, a pair of support portions 183 for supporting the guide member 170 to be movable in the upper-lower direction is formed. Further, the pressure roller 150 is rotatably supported by the respective side walls 181 of the housing 180. Further, to the respective side walls 181 of the housing 180, a coil spring 400 that is an example of a biasing member and a swing arm 410 are provided.

The coil spring 400 is a tension spring biasing the nip plate 130 toward the pressure roller 150 through the swing arm 410, the guide member 170, and the cover member 300. One end of the coil spring 400 is fixed to the housing 180, and the other end thereof is fixed to a front end portion 411 of the swing arm 410. By the biasing force of the coil spring 400, the nip plate 130 is in pressure contact with the pressure roller 150 through the fixing belt 110.

The swing arm 410 is provided to swing (move) against the housing 180. Further, by pressing the guide member 170 downward at an intermediate portion between a front end portion 411 that swings and a base end portion 412 of the swing arm 412 that is the center of rotation, both end portions (extended portions 340) of the cover member 300 in the left-right direction are configured to be pressed downward through the guide member 170.

The cover member 300, as shown in FIGS. 4 and 2, is a metal member which is in a U shape that is opened downwardly (to the side of the nip plate 130), and is arranged upper to the nip plate 130 (opposite side to the pressure roller 150) in the fixing belt 110. Specifically, the cover member 300 has a rigidity that is equal to or higher than a rigidity of the stay 160, and includes an upper side wall portion 310 and a front side wall portion 320 and a rear side wall portion 330, which are an example of a pair of first walls.

Figure 7A:
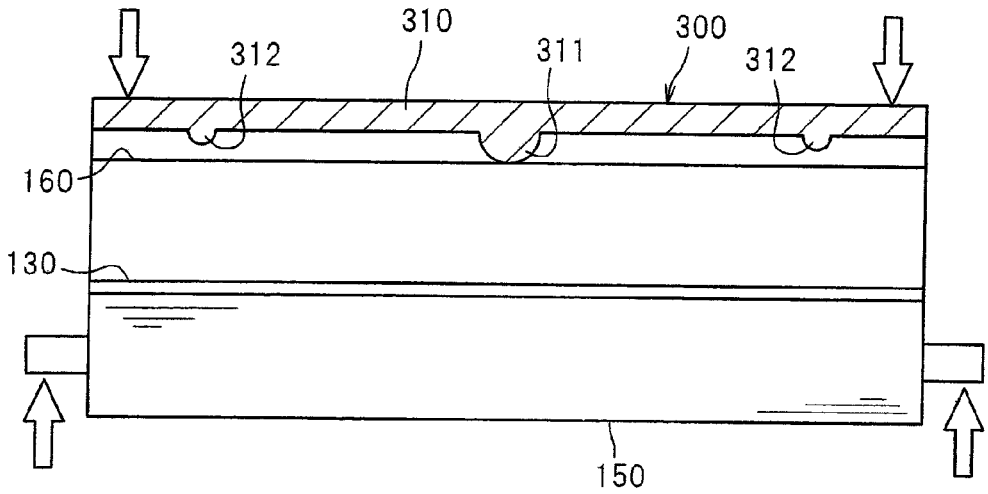
FIGS. 7A and 7B are views schematically illustrating the state of each member when a stay is pressed by a cover member.
Figure 7B:
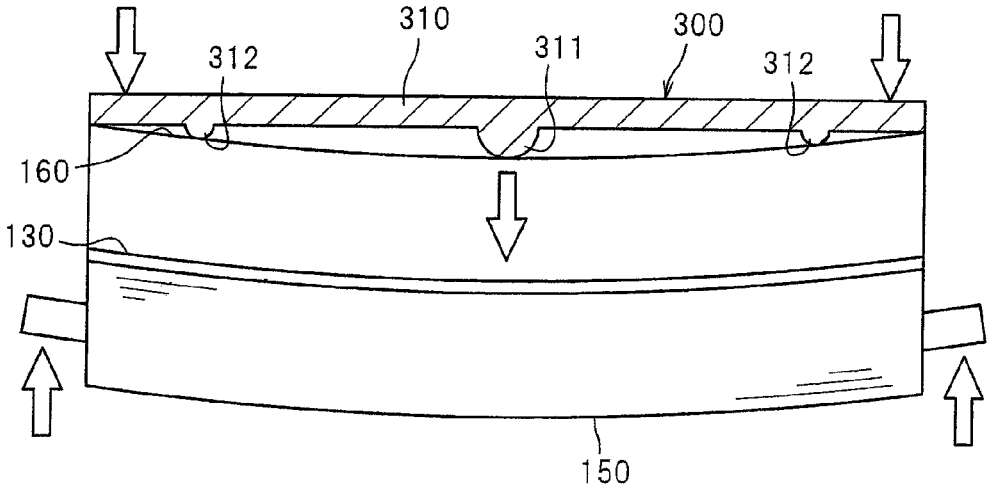

The upper side wall portion 310 is formed of an elongated plate extending in the left-right direction, and in the center portion thereof in the left-right direction, a first projection 311, which is an example of a transmission member, that transmits the biasing force applied from the coil spring 400 to the both end portions of the cover member 300 to the center portion in the left-right direction of the stay 160, is formed to project downward (to the side of the stay 160). Accordingly, as illustrated in FIGS. 7A and 7B, since the biasing force that is applied to the both end portions of the cover member 300 is intensively transmitted to the center portion of the stay 160 through the first projection 311, the stay 160 and the nip plate 130 that is supported by the stay 160 can be distorted in the same direction as the direction in which the pressure roller 150 is distorted, and thus the width of the nip portion can be substantially uniform.

Here, the force that is generated by the biasing force of the coil spring 400 is applied from the housing 180 up to the both ends of the pressure roller 150, and thus the center portion of the pressure roller 150 is downwardly concavely distorted around support points (contact points with the nip plate 130) which are a little more inside than the force-acting points. Further, since the nip plate 130 is supported by the stay 160, the nip plate 130 deforms together with the stay 160. Accordingly, as described above, the stay 160 and the nip plate 130 are distorted in the same direction as the direction in which the pressure roller 150 is distorted.

Further, as illustrated in FIGS. 4 and 2, two (plural) first projections 311 are provided at an interval in the front-rear direction. Accordingly, the center portion of the stay 160 can be pressed in the front-rear direction in a balanced manner, and thus it is possible to deform the stay 160 and the nip plate 130 that is supported on the stay 160 into an appropriate shape.

In particular, according to this exemplary embodiment, the two first projections 311 are arranged symmetrically with respect to the center portion of the upper side wall portion in the front-rear direction. Accordingly, it is possible to press the center portion of the stay 160 in the front-rear direction in a balanced manner.

Further, the first projections 311 are integrally formed to the upper side wall portion 310 of the cover member 300. Accordingly, it is possible to reduce the number of components in comparison to a structure, for example, in which a transmission member for transmitting the biasing force from the coil spring 400 to the center portion in the left-right direction of the stay 160 is provided separately from the cover member 300.

Further, by making the first projections 311, that is, a portion of the cover member 300, contact the stay 160, the contact area between the cover member 300 and the stay 160 can be made small, and thus the heat transfer from the stay 160 to the side of the cover member 300 can be suppressed to increase the heating rate of the nip plate 130.

In particular, according to this exemplary embodiment, the front end of the first projection 311 is in a hemispheric shape. Accordingly, the first projections 311 and the stay 160 are in point contact with each other, and thus it is possible to reduce the amount of heat that is transferred from the stay 160 to the cover member 300.

Further, on both end sides in the left-right direction of the upper side wall portion 310, second projections 312 are provided to project downward (to the side of the stay 160). The second projection 312 is formed to be lower than the first projection 311.

Accordingly, as illustrated in FIGS. 7A and 7B, the excessive deformation of the stay 160 through the pressing by the first projections 311 can be suppressed by the second projections 312 in the left-right direction, and thus it is possible to deform the stay 160 and the nip member 130 into an appropriate shape.

Further, as illustrated in FIGS. 4 and 2, in the same manner as the first projections 311 as described above, the two (plural) second projections 312 in the left-right direction are arranged at an interval in the front-rear direction. Specifically, the two second projections 312 in the front-rear direction are arranged symmetrically with respect to the center portion in the front-rear direction of the upper side wall portion 310.

Accordingly, it is possible to regulate the deformation of the both end sides of the stay 160 in the front-rear direction, and thus the stay 160 and the nip plate 130 can be deformed into an appropriate shape.

Further, in the same manner as the first projections 311 as described above, the second projections 312 are integrally formed with the upper side wall portion 310 of the cover member 300, and the front end of the second projection 312 is in a hemispheric shape. Accordingly, the second projections 312 and the stay 160 are in point contact with each other, and thus the second projections 312 can exhibit the same effect as the first projections 311 (reduction in the number of components and the improvement of the heating rate of the nip plate 130).

A front side wall portion 320 and a rear side wall portion 330 are formed to extend downward from front and rear side ends of the upper side wall portion 310 to face each other in the front-rear direction. Further, on both end sides in the left-right direction of the front side wall portion 320 and the rear side wall portion 330, four third projections 323 and 333 are formed in total to project inwardly in the front-rear direction.

The cover member 300 is arranged to cover the stay 160 and sandwiches the stay 160 in the front-rear direction by the third projections 323 and 333 which contacts with the stay 160. Accordingly, it is possible to support the stay 160 through the cover member 300.

Further, since the third projections 323 and 333, that is, portions of the cover member 300, are in contact with the stay 160, for example, it is possible to improve the positional accuracy by performing the position determination in the front-rear direction through sandwiching the stay 160 through the surfaces of the front side wall portion 320 and the rear side wall portion 330. Further, by making the third projections 323 and 333, that is, portions of the cover member 300, to contact the stay 160, the contact area between the cover member 300 and the stay 160 can be made small, and thus the heat transfer rate through the contact area between the cover member 300 and the stay 160 can be reduced to increase the heating rate of the nip plate 130.

Further, according to this exemplary embodiment, the front end of the third projection 323 or 333 is in a hemispheric shape. Accordingly, the third projections 323 and 333 and the stay 160 are in point contact with each other, and thus it is possible to reduce the heat transfer rate.

Further, the lower ends of the front side wall portion 320 and the rear side wall portion 330 are formed to be spaced from the nip plate 130. Accordingly, it is possible to prevent the heat of the nip plate 130 from being transferred to the cover member 300.

On the other hand, the present invention is not limited to the above-described exemplary embodiment, and can be implemented in various forms as exemplified hereinafter. In the following description, the same reference numerals are used for substantially the same structures as the above-described exemplary embodiments, and the detailed description thereof will be omitted.

Figure 8:
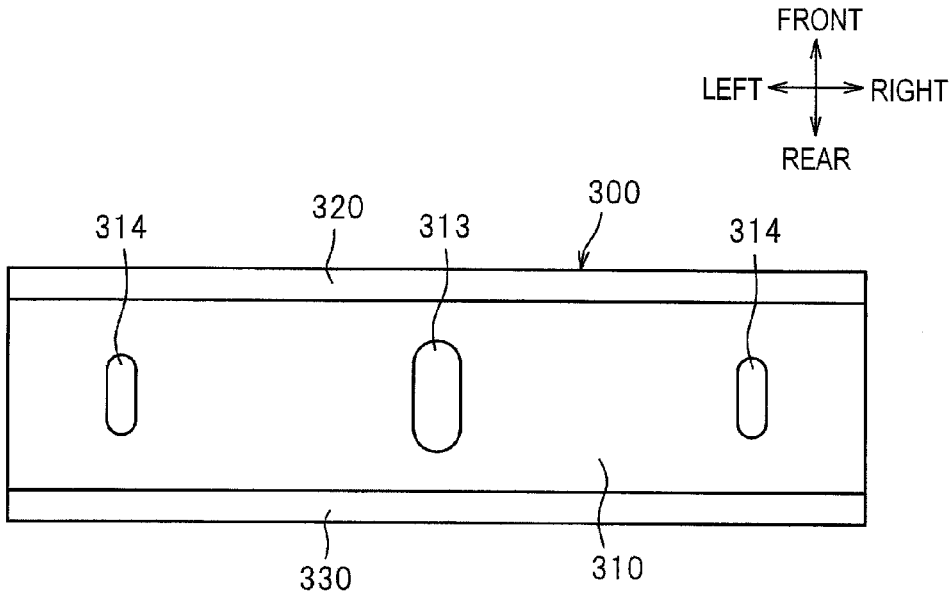
FIG. 8 is a bottom view illustrating a first projection and a second projection in an elongated shape.

In the above-described exemplary embodiment, two first projections 311 and two second projections 312 are provided at intervals in the front-rear direction. However, the present invention is not limited thereto, and three or more first projections and second projections may be provided at intervals. Further, as illustrated in FIG. 8, the first projections 313 and the second projections 314 may be in an elongated shape along the front-rear direction.

Even in this case, since the center portion of the stay 160 can be pressed by the first elongated projections in a balanced manner and the deformation of the both end sides of the stay 160 can be regulated in the conveying direction in a balanced manner by the second elongated projections, the same effect as that of the above-described exemplary embodiment can be exhibited.

Figure 9:
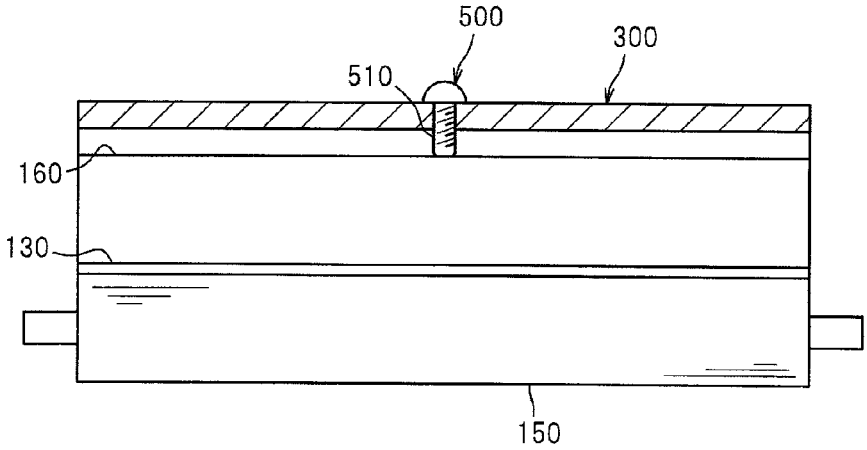
FIG. 9 is a view schematically illustrating a first projection that is configured by a front end portion of a screw.

In the above-described exemplary embodiment, the first projections 311 are integrally formed with the cover member 300. However, the present invention is not limited thereto. For example, as illustrated in FIG. 9, the first projection may be configured by a front end portion 510 of a screw 500 (a portion positioned between the cover member 300 and the stay 160) as an example of a fastening member that is fastened to the cover member 300.

Accordingly, since the height of the first projection can be simply adjusted through adjustment of the fastening amount of the screw 500, the deformation of the stay 160 can be easily fine-adjusted. On the other hand, the second projection can be configured by the front end portion of the screw in the same manner. Further, the screw fastening member is not limited to the screw 500, but may be, for example, a bolt.

Figure 10:
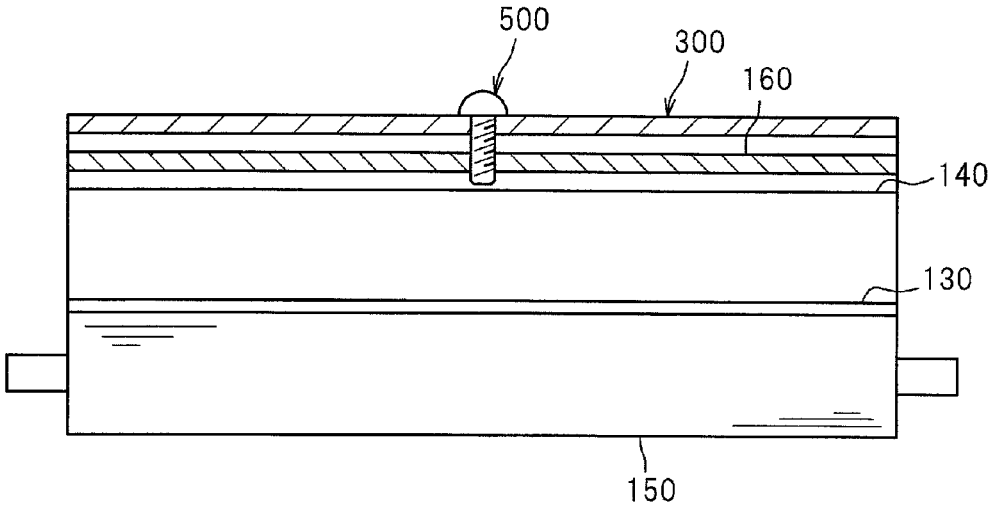
FIG. 10 is a view schematically illustrating a cover member and a stay which are screw-engaged with each other.

Further, as illustrated in FIG. 10, the cover member 300 and the stay 160 may be fixed together by the screw 500. Accordingly, the positional relationship between the cover member 300 and the stay 160 can be kept constant.

In FIG. 10, the portion of the screw 500 between the cover member 300 and the stay 160 corresponds to the transmission member, and the biasing force is transmitted by the portion of the screw 500. However, the present invention is not limited thereto, and the cover member and the stay may be fastened together by a screw fastening member that is provided separately from the transmission member. For example, in the above-described exemplary embodiment, the cover member 300 and the stay 160 may be fastened together in a state illustrated in FIG. 7B.

Figure 11:
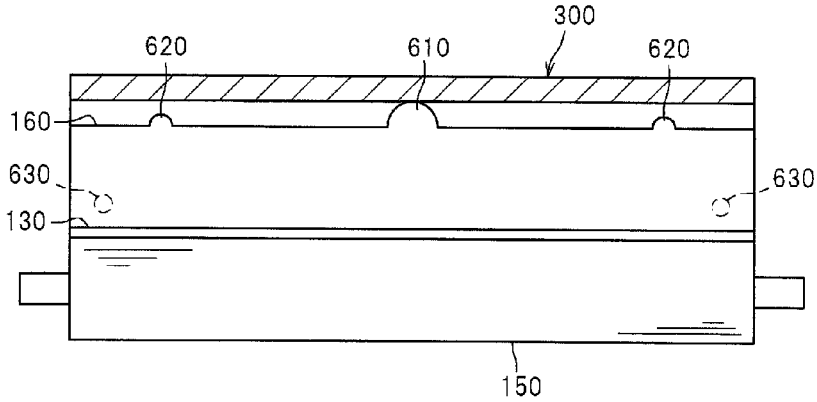
FIG. 11 is a view schematically illustrating a first projection and a second projection which are formed to a stay.

In the above-described exemplary embodiment, the first projections 311, the second projections 312, and the third projections 323 and 333 are formed to the cover member 300 (first member). However, the present invention is not limited thereto, and as illustrated in FIG. 11, first projections 610, second projections 620, and third projections 630 may be provided to the stay 160 (second member).

In the above-described exemplary embodiment, the first projections 311 and the second projections 312 are provided. However, the present invention is not limited thereto, and the second projections 312 may not be provided. Even in this case, the shape (curvature) of the stay 160 that is deformed through pressing of the center portion thereof by the first projections 311 is substantially determined only by the material, the length, and the cross-sectional shape of the stay 160, and thus the shape of the stay 160 can be made into a desired shape. However, by providing the second projections 312, the stay 160 can be more reliably made into a desired shape.

In the above-described exemplary embodiment, the nip plate 130 is provided as an example of the nip member. However, the present invention is not limited thereto, and a thick member that is not in a plate shape may be adopted as the nip member.

In the above-described exemplary embodiment, the coil spring 400 is provided as an example of the biasing member. However, the present invention is not limited thereto, and for example, the biasing member may be a leaf spring or a wire spring. Further, in the above-described exemplary embodiment, the biasing member (coil spring 400) is provided between the swing arm 410 and the housing 180 of the fixing device 100. However, the present invention is not limited thereto, and for example, the biasing member may be provided between the swing arm and the device body.

In the above-described exemplary embodiment, a sheet P such as a card board, a post card, and a thin sheet is adopted as an example of a sheet. However, the present invention is not limited thereto, and for example, the sheet may be an OHP sheet.

In the above-described exemplary embodiment, the pressure roller 150 is provided as the backup member. However, the present invention is not limited thereto, and for example, the backup member may be a belt type pressure member or the like.

The present invention provides illustrative, non-limiting aspects as follows:

(1) In a first aspect, there is provided a fixing device configured to thermally fix a developer image onto a sheet, the fixing device including: a flexible tubular member; a nip member; a backup member; a first member: a second member: a biasing member; and a transmission member. The nip member is arranged inside the tubular member. The backup member configures a nip portion by sandwiching the tubular member between the nip member and the backup member. The first member is arranged inside the tubular member and is arranged on one side of the nip member, which is opposite to another side of the nip member at which the backup member is arranged. The second member is arranged between the first member and the nip member. The biasing member presses the nip member toward the backup member side through the first member and the second member by biasing both end portions of the first member in a width direction of the sheet toward the backup member. The transmission member is provided between the first member and the second member, the transmitting member transmitting a biasing force, which is applied from the biasing member to the first member, to a center portion of the second member in the width direction of the sheet.

Accordingly, since a biasing force that is applied to both end portions of the first member is intensively transmitted to the center portion of the second member, the second member and the nip member can be distorted in the same direction as the direction in which the backup member is distorted, and thus the width of the nip portion can be made substantially uniform.

(2) In a second aspect, there is provided the fixing device according to the first aspect, wherein the transmission member includes a first projection projecting from one member of the first member and the second member toward another member of the first member and the second member.

Accordingly, by making the transmission member a projection, for example, a contact area between the first member and the second member can be made small in comparison to the transmission member that is in surface contact with the first member and the second member, and thus the amount of heat conduction through the contact portion between the first member and the second member can be reduced to increase the heating rate of the nip member.

(3) In a third aspect, there is provided the fixing device according to the second aspect, wherein a second projection is provided on both end sides of the one member in the width direction to project toward the other member, and wherein the first projection projects toward the other member side more than the second projection.

Accordingly, since the second projection can suppress excessive deformation of the second member, it is possible to deform the nip member that is deformed together with the second member into an appropriate shape.

(4) In a fourth aspect, there is provided the fixing device according to the third aspect, wherein a plurality of first projections are provided at intervals in a conveying direction of the sheet.

Accordingly, since the center portion of the second member can be pressed in the conveying direction in a balanced manner, the second member and the nip member can be deformed into an appropriate shape.

(5) In a fifth aspect, there is provided the fixing device according to the fourth aspect, wherein a plurality of second projections are provided at intervals in the conveying direction of the sheet.

Accordingly, since the deformation of both end sides of the second member can be regulated in the conveying direction in a balanced manner, the second member and the nip member can be deformed into an appropriate shape.

(6) In a sixth aspect, there is provided the fixing device according to the third aspect, wherein the first projection has an elongated shape that is formed along a conveying direction of the sheet.

Accordingly, since the center portion of the second member can be pressed in the conveying direction in a balanced manner, the second member and the nip member can be deformed into an appropriate shape.

(7) In a seventh aspect, there is provided the fixing device according to the sixth aspect, wherein the second projection has an elongated shape that is formed along the conveying direction of the sheet.

Accordingly, since the deformation of both end sides of the second member can be regulated in the conveying direction in a well balanced manner, the second member and the nip member can be deformed into an appropriate shape.

(8) In an eighth aspect, there is provided the fixing device according to the second aspect, wherein the first projection is configured by a front end portion of a fastening member that is configured to be movable by being screwed to the one member.

Accordingly, by adjusting the amount of screwing of the fastening member, the height of the first projection can be simply adjusted.

(9) In a ninth aspect, there is provided the fixing device according to the first aspect, wherein the first member and the second member are screwed together by a fastening member.

Accordingly, a positional relationship between the first member and the second member can be maintained constant.

(10) In a tenth aspect, there is provided the fixing device according to the second aspect, wherein the first member and the second member are configured to have a U-shape that is open to the nip member side, and wherein the first member is arranged to cover the second member and sandwich the second member in a conveying direction of the sheet.

Accordingly, a positional relationship between the first member and the second member in the conveying direction of the sheet can be maintained constant.

(11) In an eleventh aspect, there is provided the fixing device according to the tenth aspect, wherein a third projection projecting in the conveying direction is provided to a pair of first walls of the first member, which are opposed to each other in the conveying direction, or to a pair of second walls of the second member, which are opposed to each other in the conveying direction, and wherein the first member and the second member contacts with each other at the third projection.

Accordingly, since the position determination of the sheet in the conveying direction is performed by the third projection, the position accuracy can be improved in comparison to a position determination by contacting with a surface. Further, by making the contact portion a projection, the contact area between the first member and the second member can be made small, and thus the amount of heat conduction through the contact portion between the first member and the second member can be reduced to increase the heating rate of the nip member.

What is claimed is:

1. A fixing device configured to thermally fix a developer image onto a sheet, the fixing device comprising:

a flexible tubular member;

a nip member arranged inside the tubular member;

a backup member opposing the nip member, the nip member and the backup member configuring a nip portion by sandwiching the tubular member between the nip member and the backup member;

a first member arranged inside the tubular member and arranged on one side of the nip member, which is opposite to another side of the nip member at which the backup member is arranged;

a second member arranged between the first member and the nip member;

a biasing member pressing the nip member toward a side of the backup member through the first member and the second member by biasing both end portions of the first member in a width direction of the sheet toward the backup member; and a transmission member provided between the first member and the second member, the transmission member transmitting a biasing force, which is applied from the biasing member to the first member, to a center portion of the second member in the width direction of the sheet, wherein a heater is arranged inside the tubular member, wherein the transmission member includes a first projection projecting from one member of the first member and the second member toward another member of the first member and the second member, and wherein the heater, the nip member, the first member, and the second member are all arranged inside the tubular member.

2. The fixing device according to claim 1, wherein a second projection is provided on both end sides of the one member in the width direction to project toward the other member, and wherein the first projection projects toward a side of the other member more than the second projection.

3. The fixing device according to claim 2, wherein a plurality of first projections are provided at intervals in a conveying direction of the sheet.

4. The fixing device according to claim 3, wherein a plurality of second projections are provided at intervals in the conveying direction of the sheet.

5. The fixing device according to claim 2, wherein the first projection has an elongated shape that is formed along a conveying direction of the sheet.

6. The fixing device according to claim 5, wherein the second projection has an elongated shape that is formed along the conveying direction of the sheet.

7. The fixing device according to claim 1, wherein the first projection is configured by a front end portion of a fastening member that is configured to be movable by being screwed to the one member.

8. The fixing device according to claim 1, wherein the first member and the second member are screwed together by a fastening member.

9. The fixing device according to claim 1, wherein the first member and the second member are configured to have a U-shape that is open to a side of the nip member, and wherein the first member is arranged to cover the second member and sandwich the second member in a conveying direction of the sheet.

10. The fixing device according to claim 9, wherein a third projection projecting in the conveying direction is provided to a pair of first walls of the first member, which are opposed to each other in the conveying direction, or to a pair of second walls of the second member, which are opposed to each other in the conveying direction, and wherein the first member and the second member contact each other at the third projection.

11. The fixing device according to amended claim 1, wherein the second member is arranged to surround the heater.

* * * * *